US005913437A

United States Patent [19]

Ma

[11] Patent Number: 5,913,437

[45] Date of Patent: Jun. 22, 1999

[54] TAMPER EVIDENT BOTTLE CAP

[75] Inventor: Xiaoli Ma, San Jose, Calif.

[73] Assignee: Portola Packaging, Inc., San Jose, Calif.

[21] Appl. No.: 08/904,878

[22] Filed: Aug. 1, 1997

[51] Int. Cl.[6] ..... B65D 41/34

[52] U.S. Cl. ..... 215/252; 215/329

[58] Field of Search ..... 215/252, 329

[56] References Cited

U.S. PATENT DOCUMENTS

| | | | |
|---|---|---|---|
| 4,511,053 | 4/1985 | Brandes et al. | 215/252 |
| 4,664,278 | 5/1987 | Barriac | 215/252 |
| 4,801,031 | 1/1989 | Barriac | 215/252 |
| 4,978,016 | 12/1990 | Hayes | 215/252 |
| 5,307,945 | 5/1994 | Hidding et al. | 215/329 |
| 5,400,913 | 3/1995 | Kelly | 215/252 |
| 5,570,798 | 11/1996 | Hayashida et al. | 215/252 |
| 5,727,705 | 3/1998 | Kelly | 215/252 |

*Primary Examiner*—Stephen K. Cronin
*Attorney, Agent, or Firm*—Flehr Hohbach Test Albritton & Herbert

[57] ABSTRACT

A closure cap (10) including a tamper-indicating band (18) with an inwardly and upwardly turned retaining rim (24) having alternately positioned flutes, such as pleats (28) and arcuate portions (30). The pleats (28) are pleated radially outwardly of arcuate portions (30).

16 Claims, 8 Drawing Sheets

TAMPER EVIDENT BOTTLE CAP

BACKGROUND OF THE INVENTION

1. Field of the Invention.

This invention relates to improvements in tamper-evident bands such as those commonly used on bottle caps and, more particularly, to an improved detachable tamper-evidencing band design for improving mounting of the closure on a spout or neck of a container, as well as to improve the grip of the band on the spout.

This invention also relates to improvements in screw on thread designs of bottle closures.

2. Related Art

U.S. Pat. No. 4,801,031 discloses a tamper-indicating closure that includes an inwardly folded tamper-indicating band with intermittent pleats, around the inwardly folded portion of the band. The pleats are inwardly directed and spaced around the circumference of the band. U.S. Pat. No. 5,400,913 discloses a similar tamper-indicating closure that also has an inwardly folded tamper-indicating band with continuous pleats around the inwardly folded portion of the band.

As discussed in the '913 patent, the tamper-indicating band should slip over the locking bead or rim of the container neck without damaging the frangible web connecting the band to the skirt of the closure. The tamper-indicating band must be sufficiently elastic in order to avoid too great a resistance when closing the bottle, which could damage the frangible web. However, the tamper-indicating band should be sufficiently stiff in order to reliably engage the locking bead of the container neck and thereby hold the band beneath the locking bead when opening the closure, so that the tamper-indicating band will tear at the frangible web.

The '913 patent improves the flexibility of the inwardly folded pleated portion of the band in two ways. One, a frangible web is provided between each pleat. The frangible webs between the pleats ensure high elasticity of the tamper-indicating band during closure. Alternatively, individual bridges, instead of a frangible web, are provided between the pleats. The bridges are relatively easily damaged during opening of the closure, thus improving the tamper-indicating nature of the closure.

It has been determined by the applicant herein that the inwardly-turned pleated designs of both the '031 and '913 patents have a tendency to improperly grip the locking bead of the container neck and, thereby allow the tamper-indicating band to slip back upwardly over the locking bead upon opening of the closure, which defeats the tamper-indicating aspect of the designs. The present invention improves upon this aspect of prior art pleated tamper-indicating bands.

It is also known for the internal thread pattern of a bottle cap to include uniformly spaced gaps around the spiral thread bead for the purpose of reducing weight of the bottle cap as well as to simplify tooling production required to manufacture the bottle caps. The present invention also provides an improved spiral thread pattern and design.

SUMMARY OF THE INVENTION

Briefly described, the present invention comprises a tamper-indicating closure, such as a bottle cap, for a container with a locking surface on the neck of the container. The closure comprises a closure cap with a top portion, a depending annular skirt, and a tamper-indicating band connected to the lower edge of the annular skirt by means of a frangible connection. The tamper-indicating band includes an inwardly turned retaining rim that extends at least partially upwardly of the container neck and the retaining rim includes a free edge that is adapted to engage the locking surface of the container neck. The free edge of the retaining rim includes an arcuate portion and a fluted portion that extends outwardly of the arcuate portion. Preferably, the flutes are in the form of pleats, but other shapes are suitable.

Preferably, a series of alternating pleats and arcuate portions are provided around the upper edge of the retaining rim. The outwardly oriented pleats ensure that more of the retaining rim's upper edge is in contact with the locking surface of the container neck, which enhances the gripping of the neck by the retaining rim, thus keeping the retaining rim beneath the locking surface when the closure cap is initially unscrewed.

The provision of outwardly oriented pleats in combination with arcuate portions for engaging the locking surface also makes it more difficult to tamper with the closure cap. An attempt to pry the tamper-indicating band outwardly with a screw driver, for example, is rendered difficult by the extent of the retaining rim in contact with the locking surface. Prior art inwardly pleated rims have less contact with the locking surface, and therefore have less surface that needs to be outwardly displaced in order to slip the band over the locking surface without breaking the frangible connections.

The present invention also comprises a closure cap for sealing the opening of a container having a threaded neck comprising a top portion, a downwardly depending skirt forming a cylindrical cap body, and a thread pattern on the inner surface of the skirt, the thread pattern including thread segments that are chord shaped. The chord shaped thread segments have a straight inner edge, which creates a deeper center and progressively shallower out ends. Preferably, the thread segments are aligned with thread segments above and below. The thread segments are aligned with the thread segments to either side, so as to form an intermittently defined thread groove.

Intermittent thread segments that are chord shaped reduce the weight of the closure cap and also substantially reduce tooling costs for manufacturing the closure caps.

BRIEF DESCRIPTION OF THE DRAWINGS:

The accompanying drawings, which are incorporated in and form a part of this specification, illustrate embodiments of the invention and, together with the description serve to explain the principles of the invention, wherein.

DETAILED DESCRIPTION OF THE PREFERRED EMBODIMENT

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
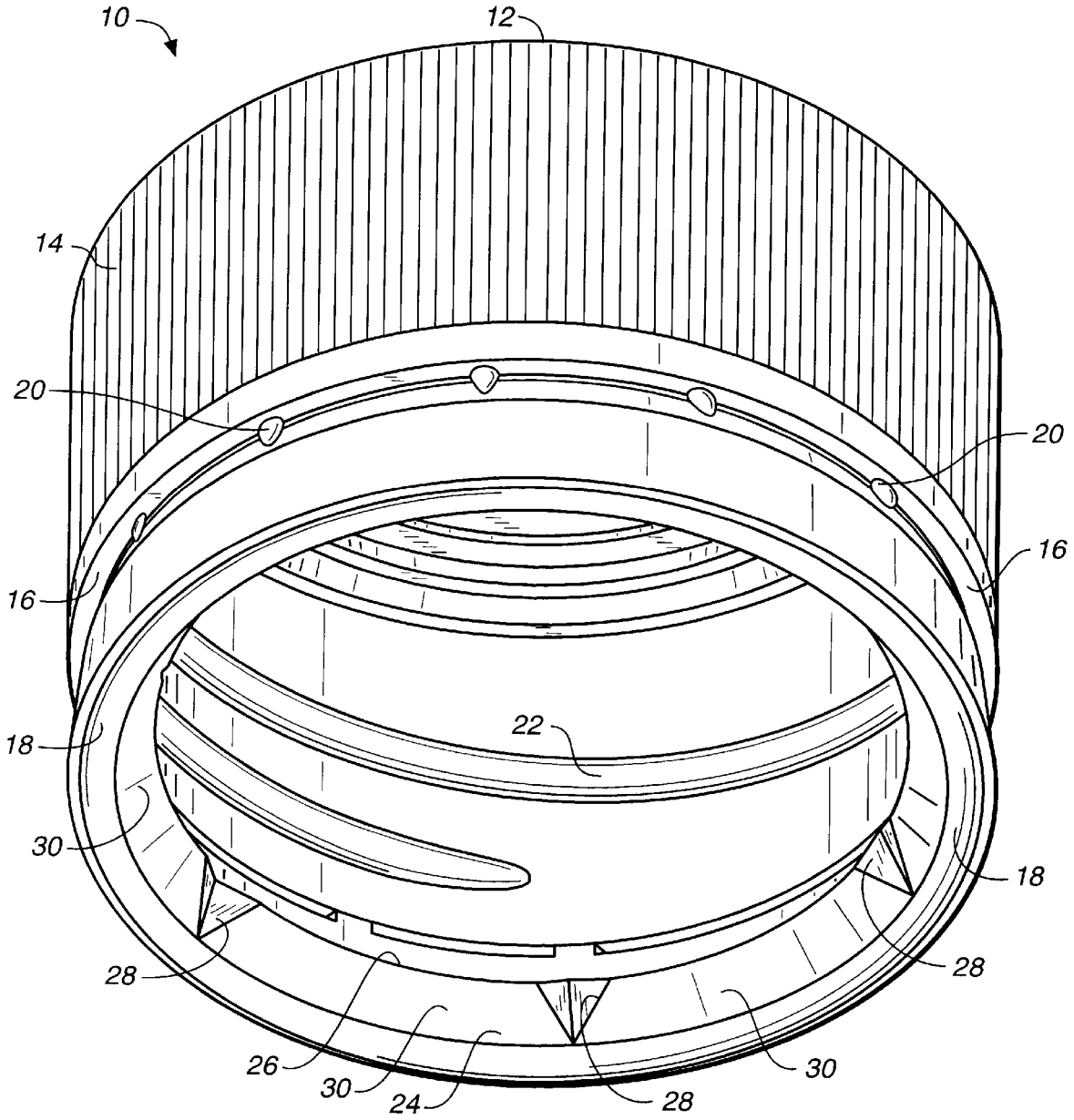
FIG. 1 is a pictorial view of the bottle cap of the present invention.

Referring to FIG. 1, bottle cap 10 forms a closure for capping off a spout or container neck of a bottle (not shown). Bottle cap 10 includes a round top portion 12 and a depending annular or cylindrical skirt 14. Skirt 14 includes a lower edge 16, to which a tamper-indicating band 18 connects by means of a frangible connection in the form of thin-walled, breakable connections 20. The internal side wall of skirt 14 includes a conventional spiral thread bead 22. The novelty of the embodiment of the present invention shown in FIG. 1 is believed to reside in the design of tamper-indicating band 18 and, accordingly, the design of top portion 12 and depending annular skirt 14 by themselves form no part of the present invention.

Tamper-indicating band 18 includes an inwardly and upwardly turned, annular retaining rim 24. Retaining rim 24 includes an upper free edge 26. The free edge 26 includes pleats 28, which are pleated radially outwardly, and arcuate portions 30 therebetween.

Figure 2:
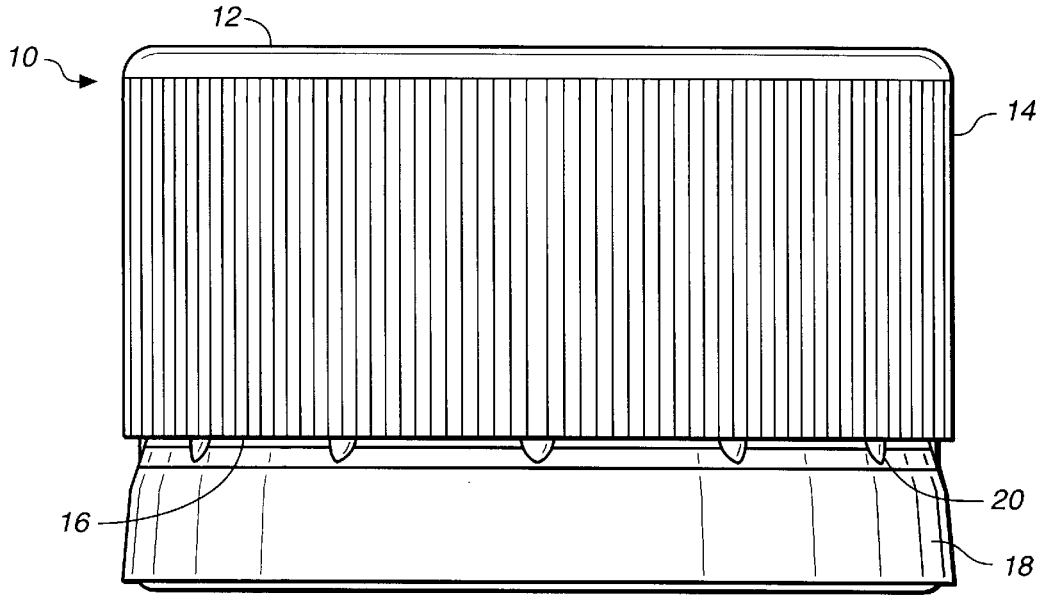
FIG. 2 is a side elevation view of the bottle cap of FIG. 1.
Figure 3:
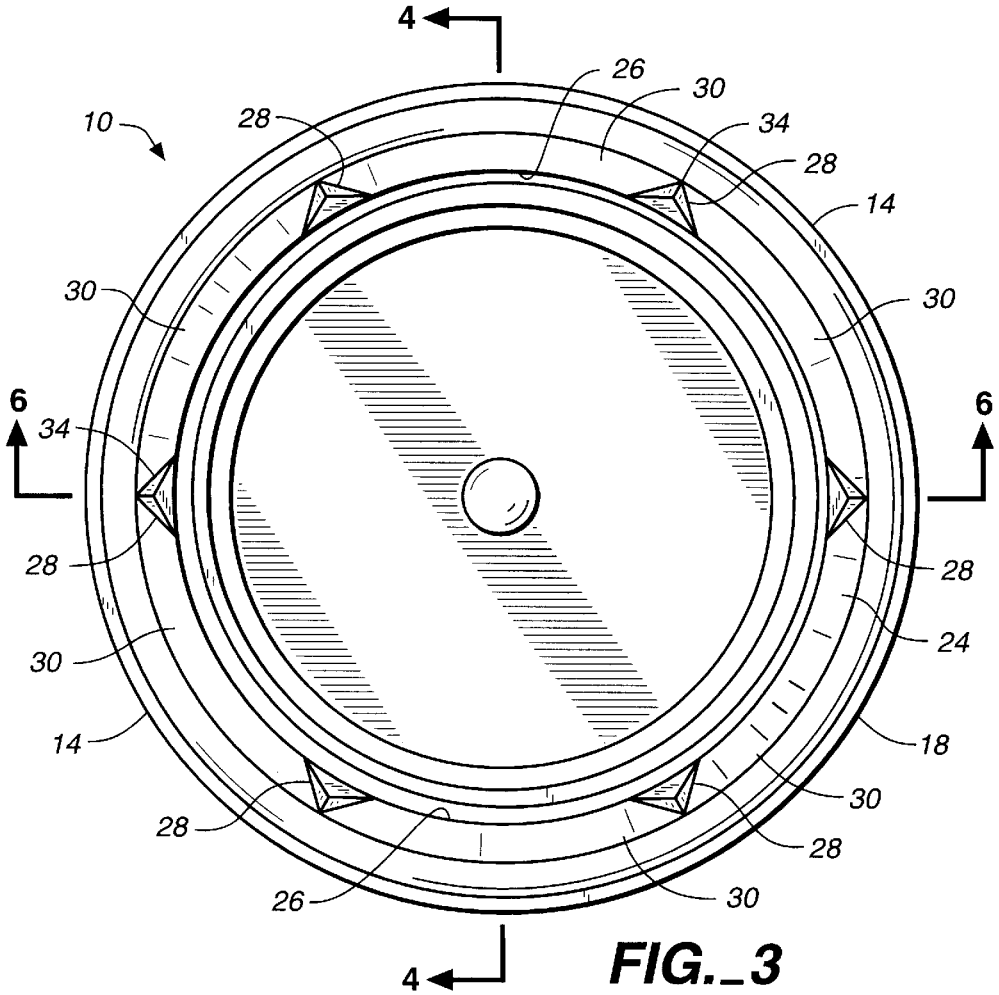
FIG. 3 is a bottom plan view of the bottle cap of FIG. 2.
Figure 4:
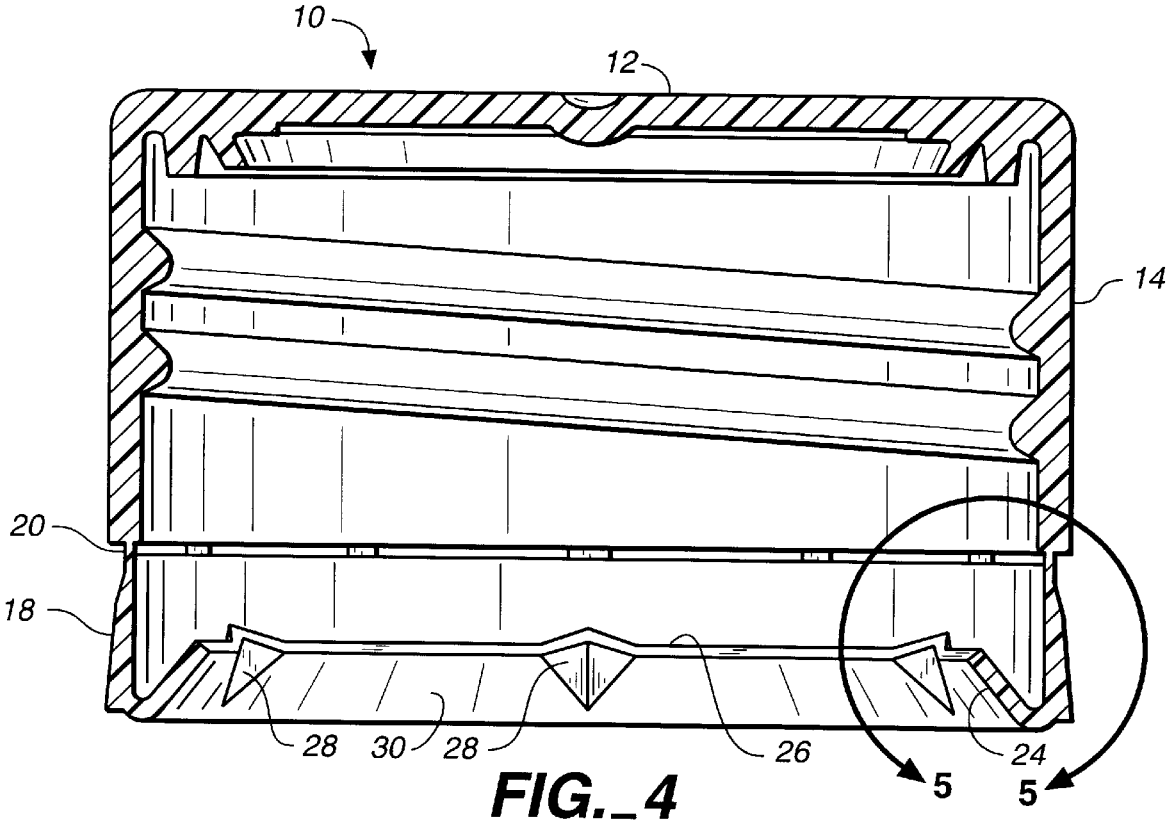
FIG. 4 is a sectional view, taken along the line 4—4 of FIG. 3.
Figure 5:
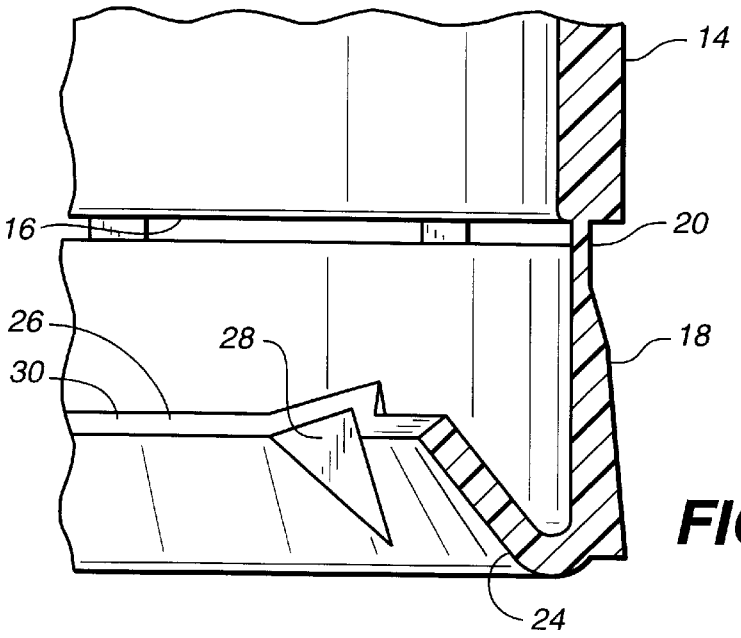
FIG. 5 is an enlarged, detail view of the retaining rim of the bottle cap of FIG. 4.
Figure 6:
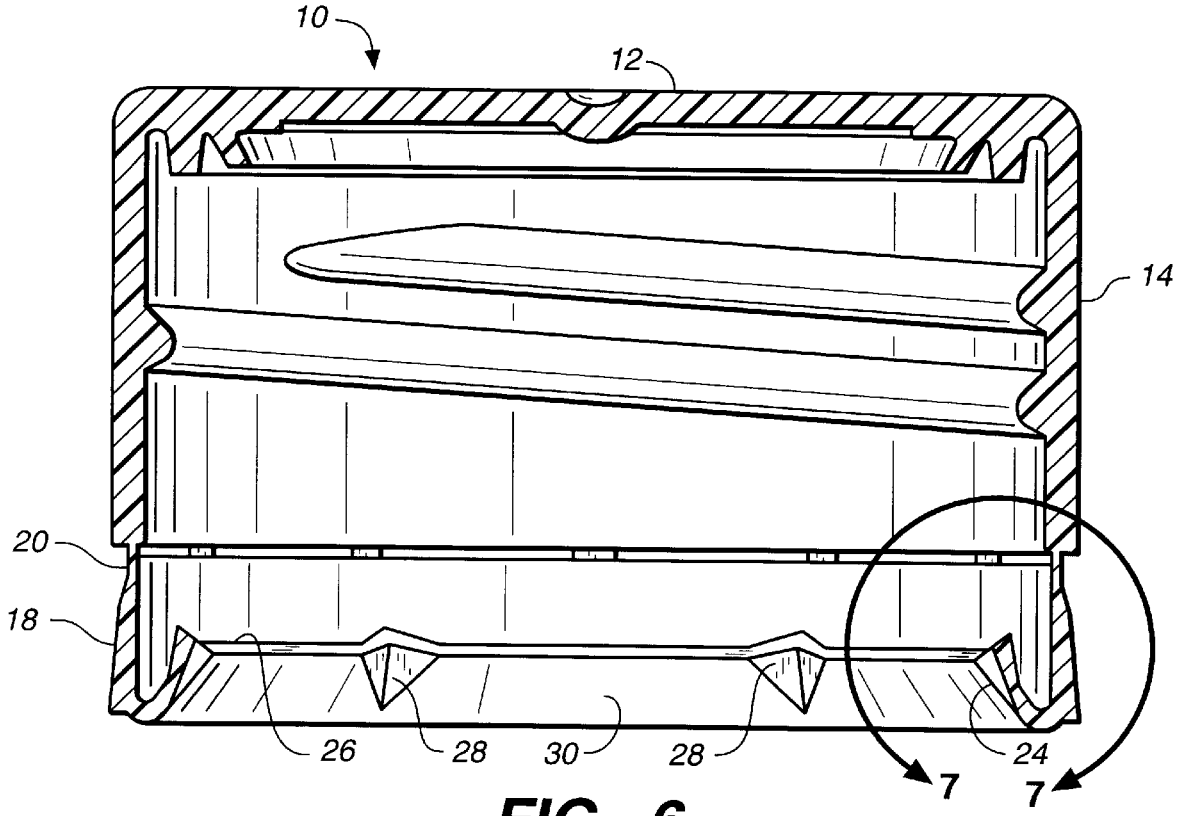
FIG. 6 is a sectional view, taken along the line 6—6 of FIG. 3.
Figure 7:
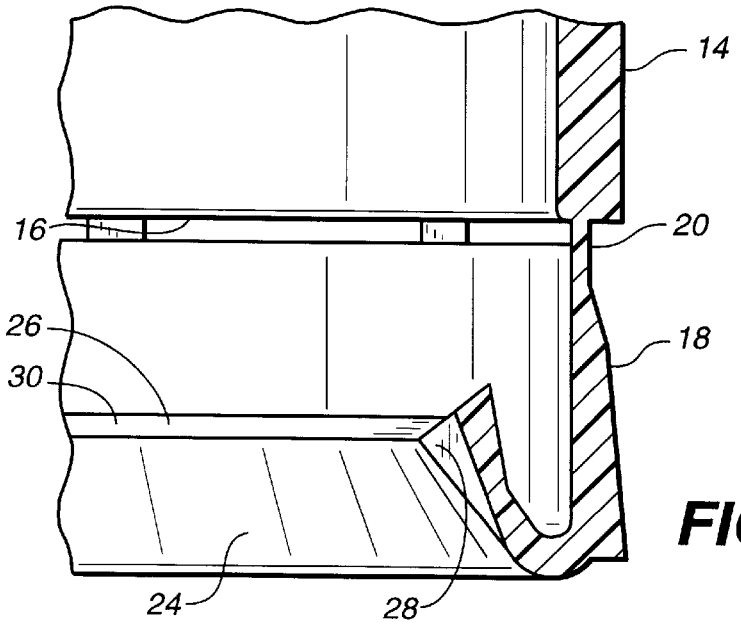
FIG. 7 is an enlarged, detail view of the retaining rim of the bottle cap of FIG. 6.

Referring to FIGS. 2 and 3, bottle cap 10 includes a series of frangible connections 20 that are formed by thin wall segments which have sufficient compressive rigidity to withstand the compressive forces imposed by tamper-indicating band 24 as the bottle cap is mounted onto a container spout, yet also has minimal tensile strength so that the frangible connections 20 break when the bottle cap is threaded back off of the container spout.

A series of six flutes 28 are formed in the upwardly and inwardly turned retaining rim 24. While the present invention is not meant to be limited to a particular number of flutes, it is desirable to provide at least two flutes and preferably at least four. In the embodiment shown, the flutes are formed as pleats, six in number. However, other flute designs can be used so long as the design allows the upper edge of the rim to expand. Provision of six pleats, of course, creates six arcuate portions 30 along the free edge 26. Arcuate portions 30 have a radius of curvature that approximates the curvature of the container spout so that when the bottle cap is mounted onto the container neck, the upper edge 26 of the arcuate portions firmly grips a locking surface on the container neck.

Pleats 28 are pleated radially outwardly of arcuate portions 28. In other words, pleats 28 fold outwardly of arcuate portions 30 toward the depending annular skirt 14. Pleats 28 include a vertex 34 that is spaced a short distance inwardly of skirt 14. Preferably, the depth of pleats 28 is sufficient that the outer extremity 34, i.e. the vertex, of each pleat remains underneath the locking surface of the container neck. This is discussed in more detail with reference to FIG. 11.

Referring to FIGS. 4–7, the inwardly turned retaining rim 24 extends at least partially upwardly so that its upper free edge 26 faces upwardly and is positioned to engage the locking surface of the container neck. It can also be seen in these figures that the pleats 28 extend radially outwardly from arcuate portions 30. It is known to provide inwardly projecting pleats, such as those found on the bottle caps disclosed in the prior mentioned Kelly '913 patent and the Barriac '031 patent. Inwardly projecting pleats result in less upper free edge contact with the locking surface of the container neck, which can result in the retaining rim slipping over the locking surface without the frangible connections breaking when the bottle cap is initially unscrewed off of the container neck.

The thin wall construction of frangible connections 20 allows for relatively easy breakage of the frangible material when the free edge 26 of retaining rim 24 engages the locking surface of the container neck. Yet, frangible connections 20 have sufficient compressive strength to withstand the initial compressive forces of tamper-indicating band 18 when the bottle cap is first threaded onto the container neck.

Figure 8:
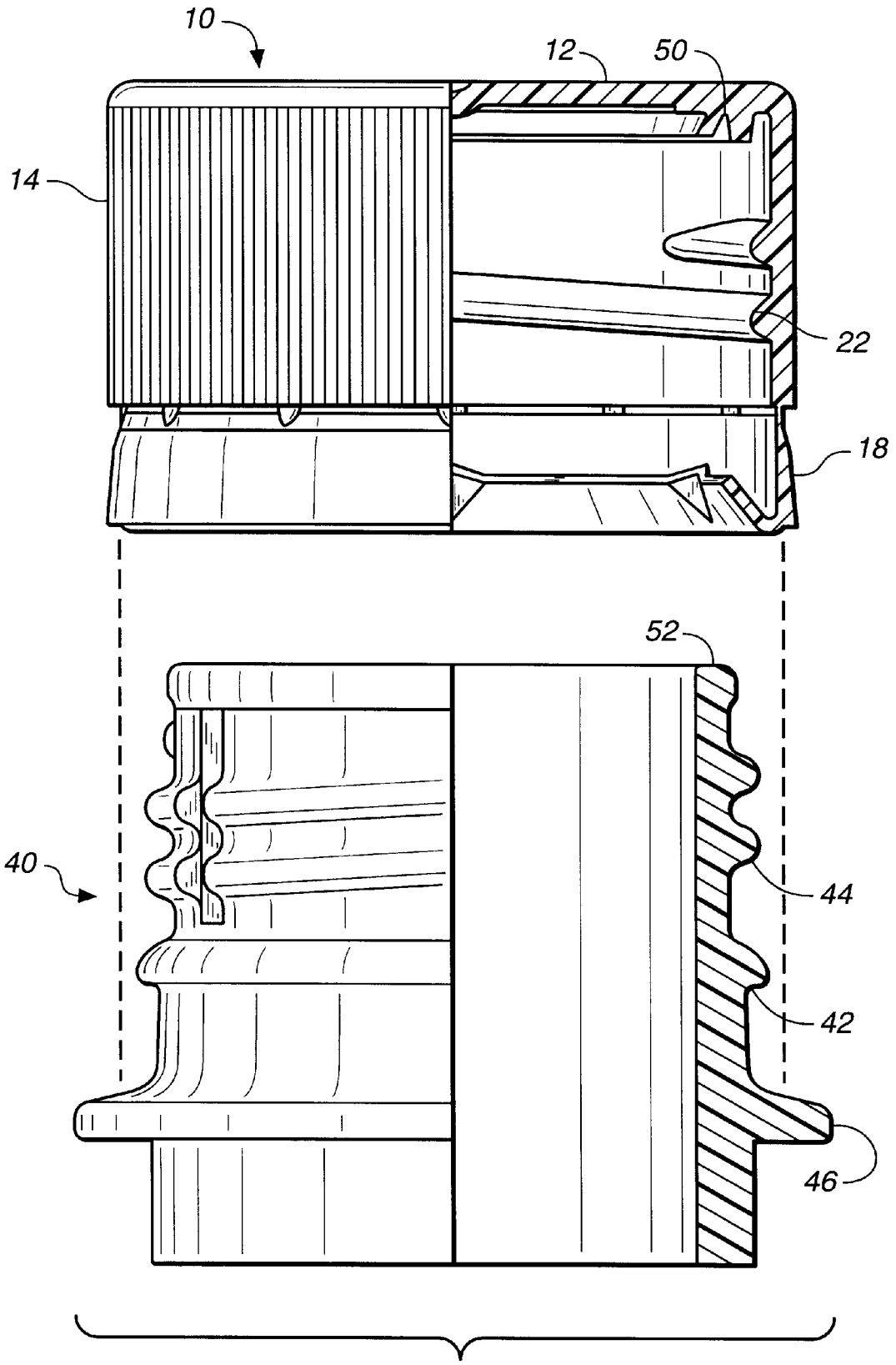
FIG. 8 is an exploded view of the bottle cap of FIG. 1 and a container neck, with the bottle cap and container neck shown in quarter section.
Figure 9:
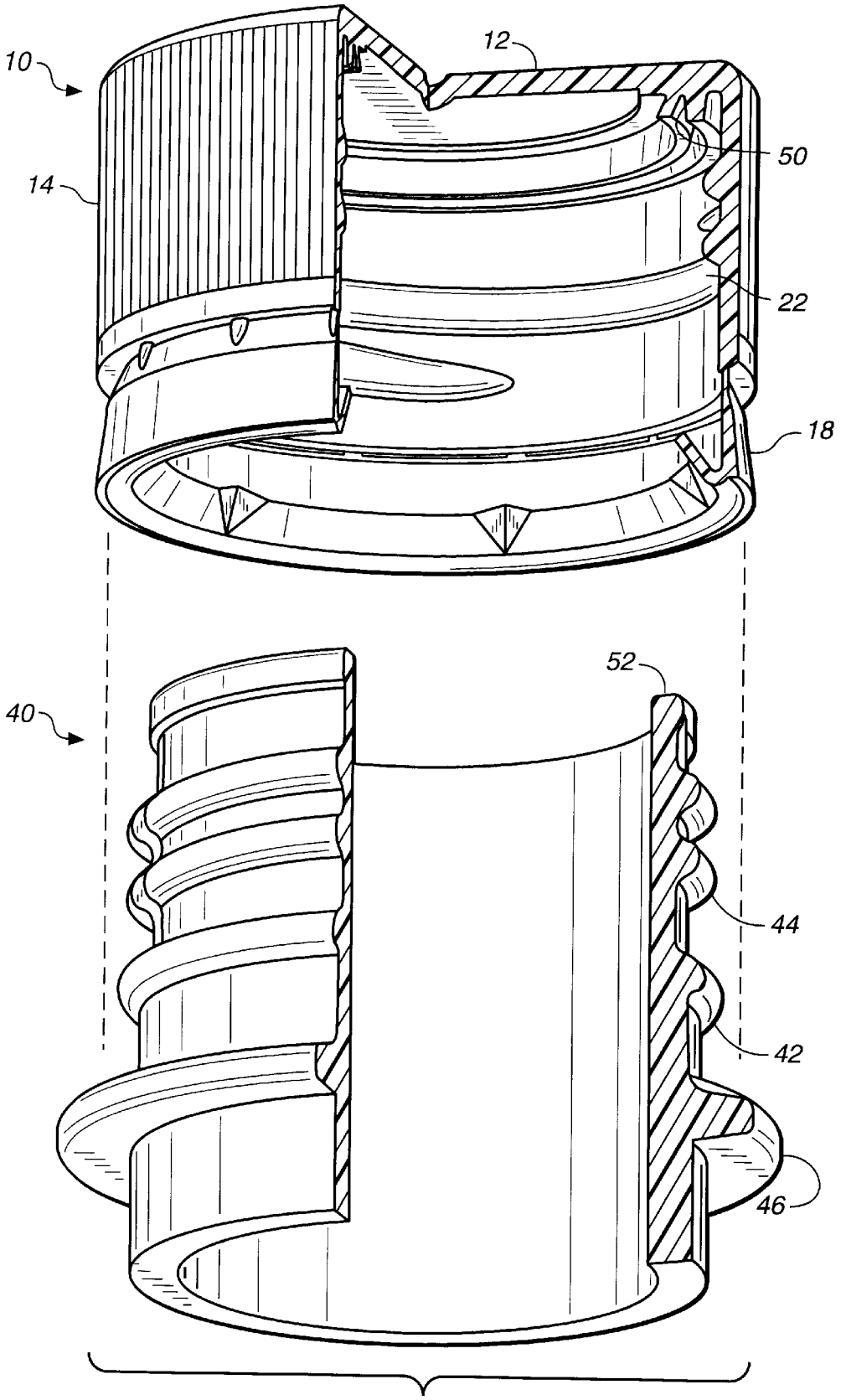
FIG. 9 is an exploded pictorial view of the bottle cap and container neck of FIG. 8.

FIGS. 8 and 9 illustrate a design for a conventional bottle neck 40. The design of bottle neck 40 forms no part of the present invention aside from the fact that the bottle neck 40 requires some type of locking surface 42, such as an annular bead, rim or the like. The rest of the features of bottle neck 40 are conventional in design, including thread 44 and annular base flange 46. The retaining rim of the bottle cap locks underneath locking surface 42.

Also shown in FIGS. 8 and 9 is an internal annular groove 50, which mates with the upper rim 52 of bottle neck 40. This creates a leak-proof seal around the opening of the bottle neck 40.

Figure 10:
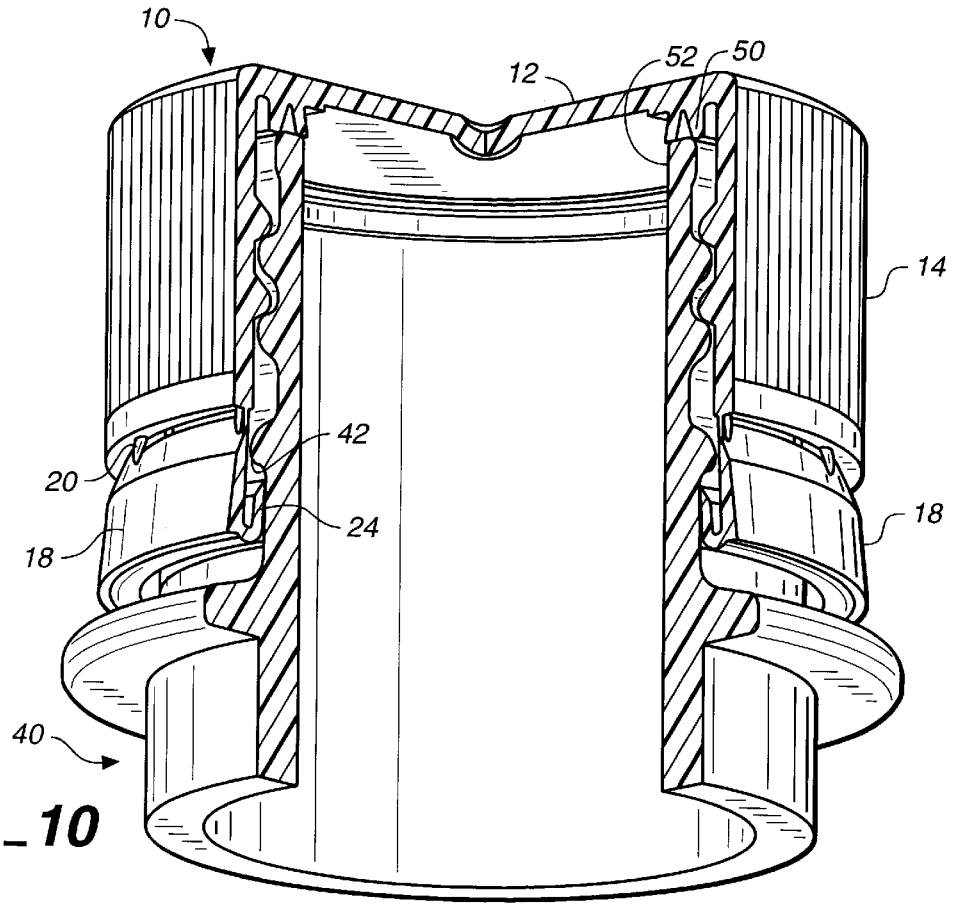
FIG. 10 is a quarter section pictorial view of the bottle cap mounted onto the container neck.
Figure 11:
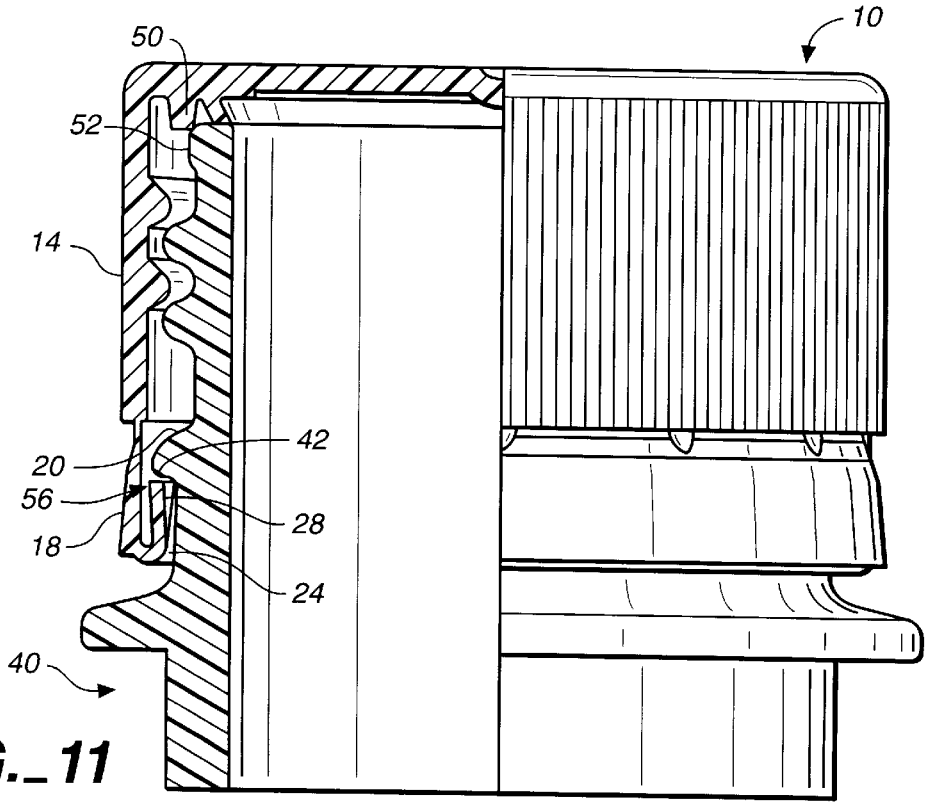
FIG. 11 is a side elevation view, shown in partial section, of the bottle cap mounted onto the container neck.

FIGS. 10 and 11 show bottle cap 10 thread mounted onto bottle neck 40. Retaining rim 24 is bent and flexed outwardly to expand its diameter to match the diameter of bottle neck 40. The upper edge of retaining rim 24, including the upper edge of pleats 28, engage locking surface 42. It can be seen in FIG. 11 that there is a small gap 56 between pleat 28 and the inside wall of tamper-indicating band 18.

When bottle cap 10 is unscrewed off of bottle neck 40, retaining rim 24 engages locking surface 42. Due to the position of frangible connections 20 on the outside of locking surface 42, a slight torque is placed on the retaining rim, which may tend to cause retaining rim 24 to move outwardly toward tamper-indicating band 18. If this happens, pleats 28 engage band 18 and prevent the upper free edge of the retaining rim from moving outwardly from underneath the locking surface, which would allow the tamper-indicating band to slip over the locking surface without breaking the frangible connections.

Another advantage of the design of the tamper-indicating band of the present invention is that it is more difficult to "tamper" with the band. Theoretically, it is possible to pry the tamper-indicating band out beyond the locking surface, with the use of a flat edge tool such as a standard screw driver. With prior art designs, only the inwardly directed pleats needed to be pried out over the locking surface. With the present design, because the retaining rim includes arcuate portions that engage the locking surface across at least a majority of the upper free edge surface of the retaining rim, it is more difficult to pry outwardly enough of the retaining rim to slip the tamper-indicating band out over the locking surface.

Figure 12:
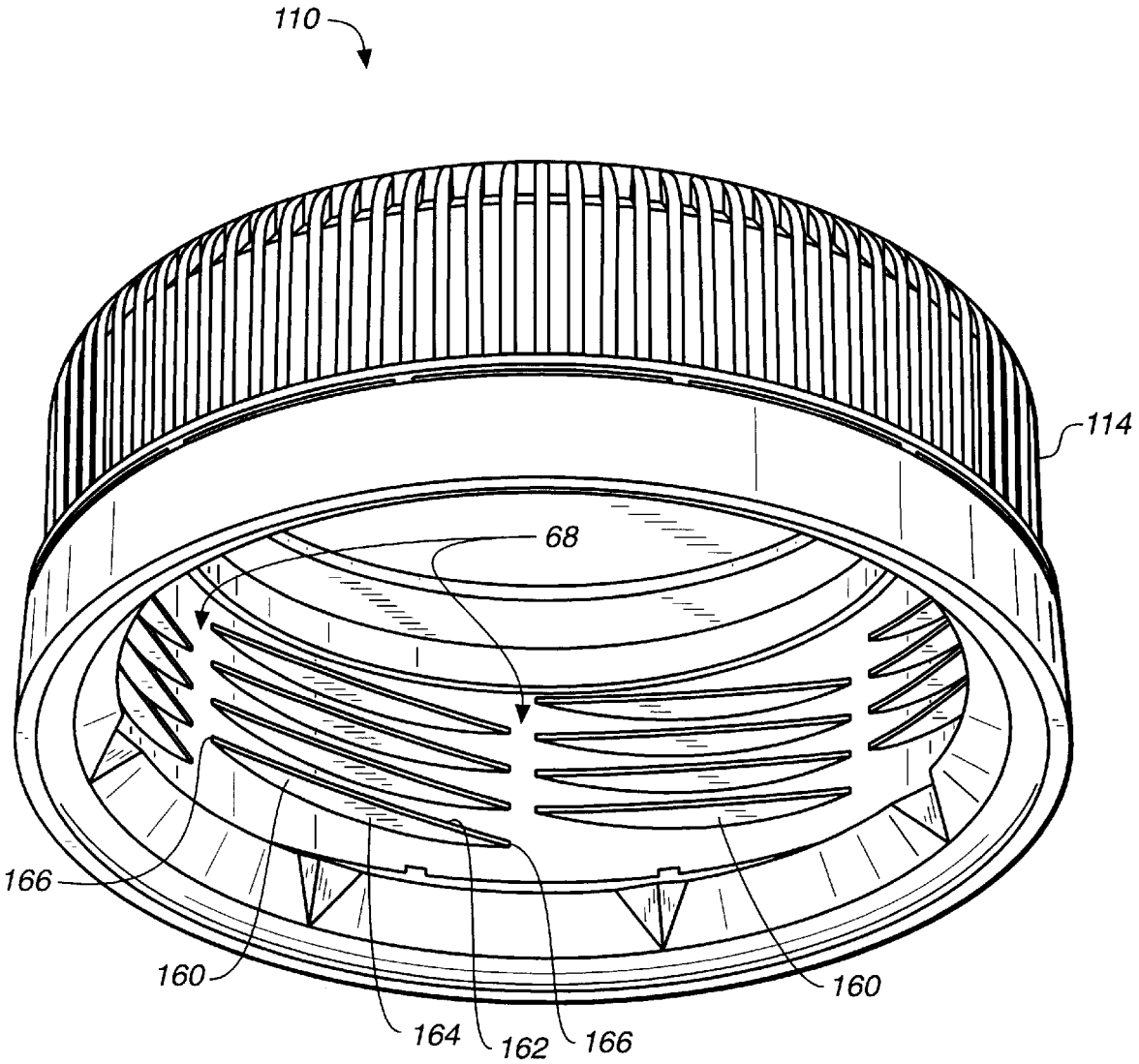
FIG. 12 is a pictorial view of an alternative embodiment of the internal thread pattern of the bottle cap of FIG. 1.

FIG. 12 illustrates the design for an alternative embodiment for the internal thread pattern of the bottle cap 110. It can be seen that the thread pattern is formed by a series of thread segments 160. Each thread segment 160 is shaped like a chord segment with a straight inner edge 162 that creates a wider depth at its center 164 and progressively becomes shallower out to its ends 166, where it becomes flush with the inner surface of skirt 114.

Thread segments 160 are vertically aligned with the segments above and below in a manner that creates gaps 168. In addition, thread segments 160 are aligned along a spiral path with the segments at either side, so as to create an intermittently defined thread channel for the thread of a container neck.

An advantage of the thread design shown in FIG. 12 is not only that it creates a much more light weight bottle cap, it is also much easier to manufacture from a tooling standpoint. Molds for injection molding bottle caps like those discussed herein can more easily be fabricated for producing thread segments as shown.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A tamper-indicating closure for a container with a locking surface on the neck of the container, comprising a closure cap with a top portion and a depending annular skirt, a tamper-indicating band connected to the lower edge of the annular skirt by means of a frangible connection, the tamper-indicating band including an inwardly turned retaining rim that extends at least partially upwardly relative to the container neck, the retaining rim including a free edge that is adapted to engage the locking surface of the container neck, the free edge of the retaining rim including an arcuate portion and a fluted portion that extends outwardly of the arcuate portion and wherein the fluted portion if formed by a pleat.

2. The closure of claim 1 wherein, the arcuate portion comprises at least a majority of the free edge of the retaining rim.

3. The closure of claim 1 wherein, a plurality of arcuate portions and pleated portions are provided alternately around the free edge of the retaining rim.

4. The closure of claim 1 wherein, the arcuate portion is curved along a radius substantially equal to the radius of curvature of the container neck.

5. The closure of claim 4 wherein, the retaining rim is inwardly turned in a manner positioning the arcuate portion of its free edge underneath the locking surface of the container neck.

6. The closure of claim 1 wherein, the fluted portion includes an outer extremity of minimal projection so that it does not extend outwardly of the locking surface.

7. The closure of claim 6 wherein, the retaining rim is inwardly turned at an angle that defines the free edge of the retaining rim with a diameter generally smaller than the diameter of the container neck.

8. The closure of claim 1 wherein, the closure cap includes internal thread segments that are chord shaped.

9. The closure of claim 8 wherein, the chord shaped thread segments have a wide diameter center and become progressively shallower toward their outer ends.

10. The closure of claim 9 wherein, the chord shaped thread segments have a straight inner edge.

11. A closure cap for sealing the opening of a container having a threaded neck, comprising a top portion, a downwardly depending skirt forming a cylindrical cap body, and a thread pattern on the inner surface of the skirt, the thread pattern including thread segments that are chord shaped with a straight inner edge.

12. The closure of claim 11 wherein, the thread segments are grouped with at least two thread segments aligned one above the other.

13. The closure of claim 12 wherein, the aligned thread segments form gaps therebetween.

14. The closure cap of claim 11 wherein, the chord shaped thread segments have a deeper center and progressively become shallower out toward their ends.

15. The closure of claim 14 wherein, the thread segments are aligned with thread segments above and below.

16. The closure of claim 14 wherein, the thread segments are aligned with the thread segments to either side, so as to form an intermittently defined thread groove.

* * * * *